United States Patent [19]

Schoenfelder et al.

[11] 4,374,329

[45] Feb. 15, 1983

[54] SMOKE DETECTOR WITH TEST APPARATUS

[75] Inventors: George A. Schoenfelder, Downers Grove; Gerald D. Rork, Sleepy Hollow; Richard E. Hiltenbrand, Naperville, all of Ill.

[73] Assignee: Pittway Corporation, Aurora, Ill.

[21] Appl. No.: 257,095

[22] Filed: Apr. 24, 1981

[51] Int. Cl.[3] ..... G08B 29/00

[52] U.S. Cl. ..... 250/574; 356/338; 340/630

[58] Field of Search ..... 250/574; 340/630; 356/338

[56] References Cited

U.S. PATENT DOCUMENTS 3,882,477 5/1975 Mueller .

4,053,785 10/1977 Lee et al. ..... 250/574

4,099,178 7/1978 Ranney et al. ..... 250/574 X

*Primary Examiner*—David C. Nelms

*Assistant Examiner*—Darwin R. Hostetter

*Attorney, Agent, or Firm*—Dithmar, Stotland, Stratman & Levy

[57] ABSTRACT

A photoelectric smoke detector includes a light source and a light responsive cell and a smoke chamber therebetween all located within a generally cylindrical inner housing which is in turn concentrically located within a generally cylindrical outer housing. The inside surface of the outer housing is reflective, but the inner housing normally prevents light emitted by the light source into the smoke chamber from striking the outer housing. The inner housing contains one or more windows and is rotatable to move the windows to a position wherein light from the source can pass therethrough to the reflective surface of the outer housing and be reflected thereby back to the light responsive cell. The amount of light striking the reflective surface can be continuously adjusted between a normal condition when no light is reflected and a full test condition when a maximum quantity of light is reflected to the light responsive cell. Instead of having windows therein, the inner housing may alternatively have reflective portions thereon. The inner housing is resiliently biased to its normal condition and an actuating tool is provided for effecting rotation thereof.

32 Claims, 16 Drawing Figures

FIG. 8
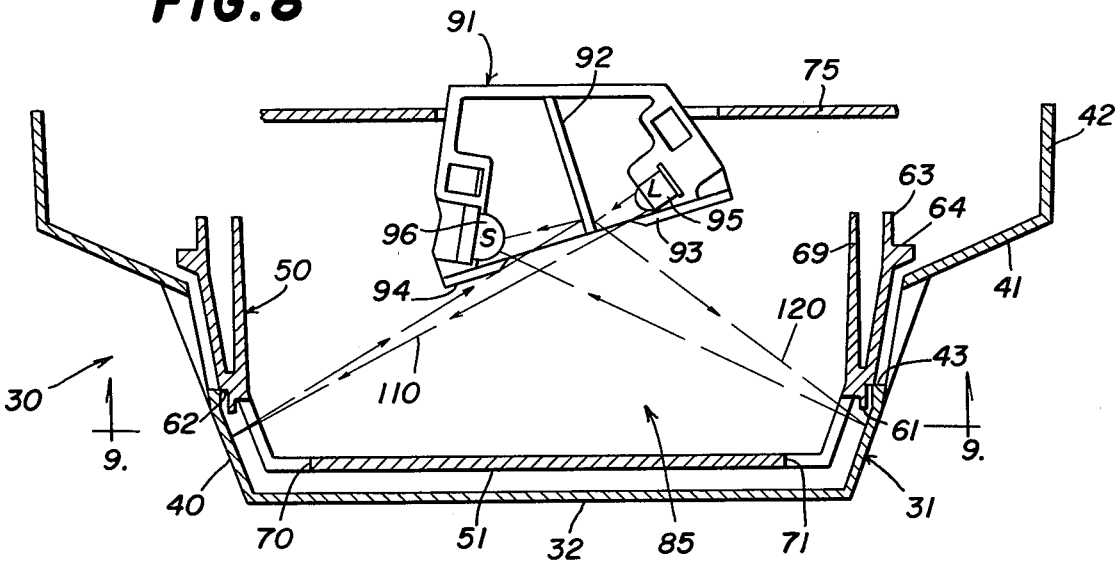
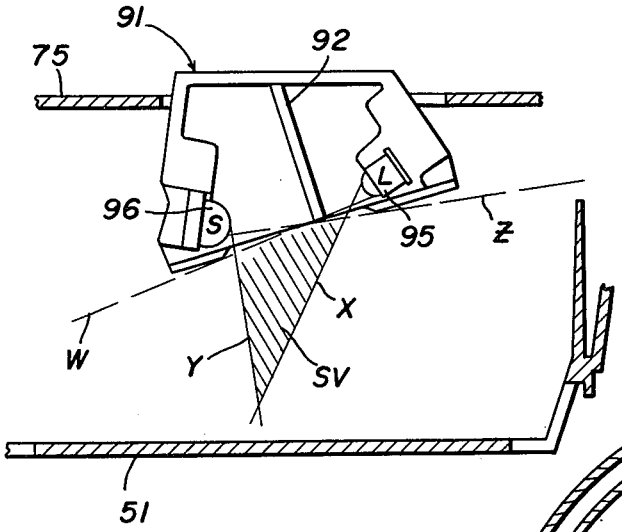
FIG. 8A
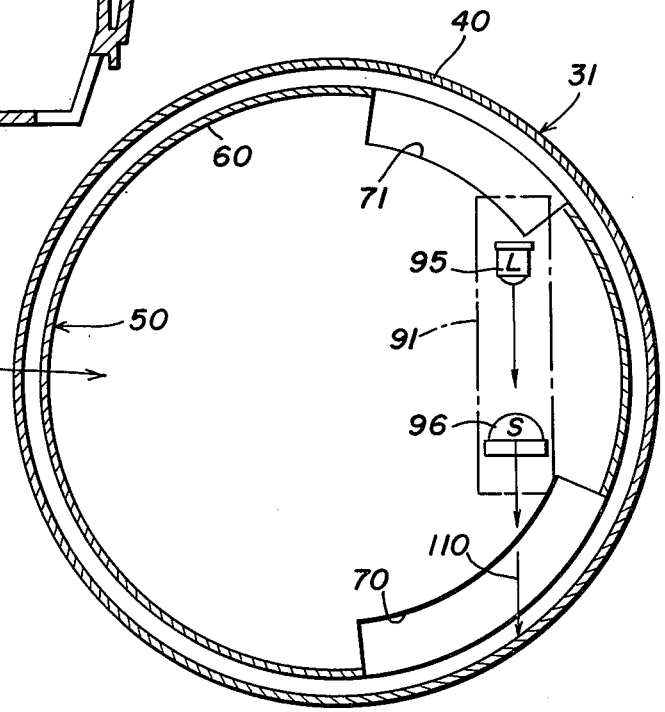
FIG. 9
MAX. TEST

FIG. 10
MIN. TEST
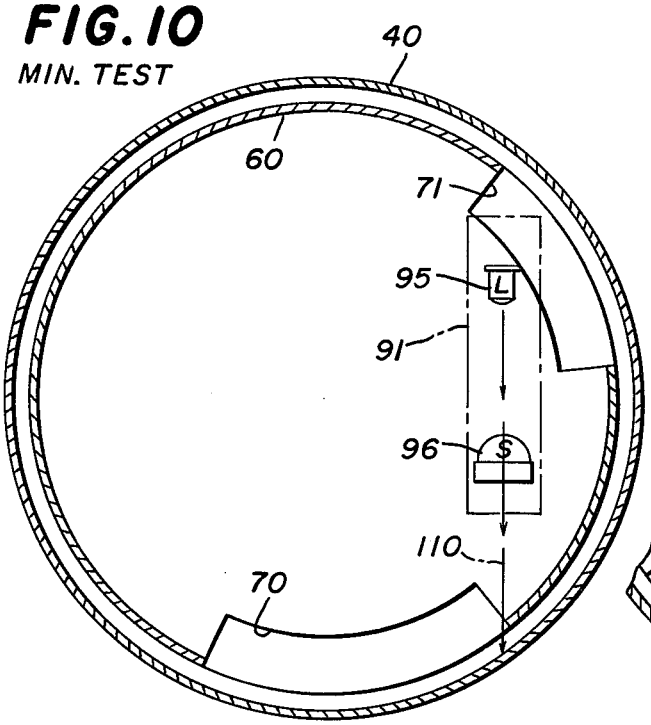
FIG. 11
NORMAL
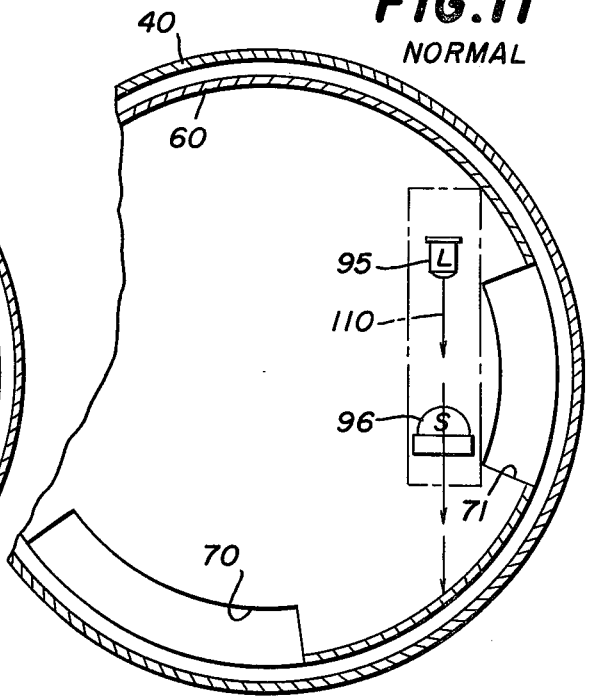
FIG. 12
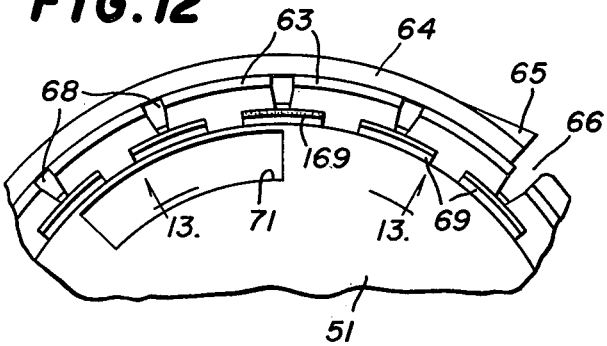
FIG. 13
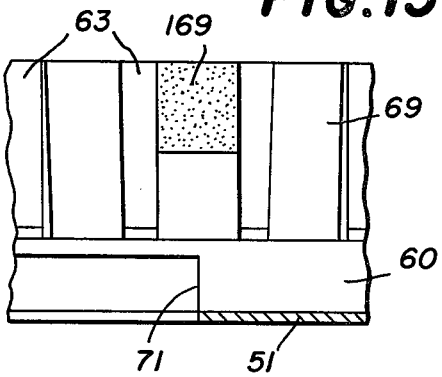
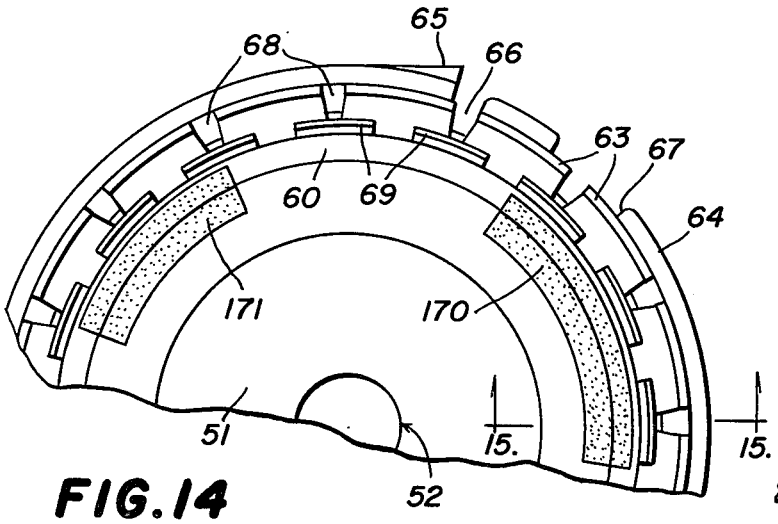
FIG. 14
FIG. 15
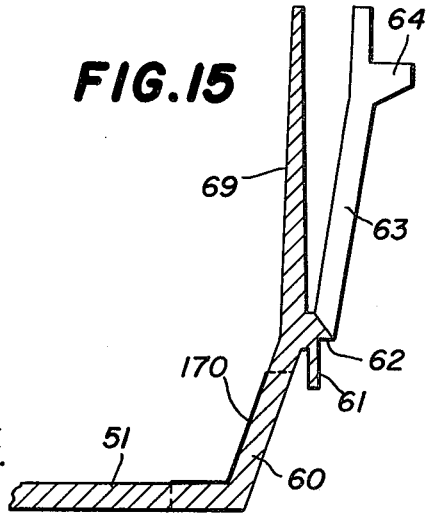

SMOKE DETECTOR WITH TEST APPARATUS

BACKGROUND OF THE INVENTION

The present invention relates to photoelectric smoke detectors and particularly those of the reflected-light type. The invention is particularly concerned with means for testing the sensitivity of such smoke detectors.

A reflecting-type photoelectric smoke detector typically includes a dark smoke chamber into which light is directed from a light source. This light is reflected by smoke particles in the smoke chamber to a light responsive cell such as a photodiode for actuating an alarm when the smoke density in the smoke chamber and, therefore, the amount of light reflected to the photodiode, exceeds a predetermined level.

Since the purpose of a smoke detector is to be immediately activated in the event of a fire at any time of the day or night, it is necessary that some means be provided for testing how well the smoke detector is functioning in the field. In particular, it is necessary to be able to test the sensitivity of the device, i.e., the smoke density at which the detector alarm will be actuated. Since it is normally impractical to expose a smoke detector in the field to an increasing amount of smoke, and even more impractical to quantify the amount of smoke to which the detector is being exposed, the next best thing is to closely simulate the presence of smoke in the smoke chamber to determine the level at which the alarm will be actuated.

A number of techniques have heretofore been used to test the sensitivity of photoelectric smoke detectors. One such technique, disclosed in U.S. Pat. No. 4,053,785 involves means for gradually increasing the amount of light from an auxiliary light source which is allowed to reach the photodiode to determine the point at which the alarm will be actuated. But such an approach does not make the pertinent evaluation, i.e., how the system will respond to the primary light source which is used during normal operation. Thus, such a system may test perfectly even though it has a defective primary light source.

Another technique is illustrated in U.S. Pat. No. 4,099,178 which involves the use of an alternate light path to the photodiode for test purposes. The system in that patent has a normally-closed test light path which does not pass through the smoke chamber, and which can be opened for test purposes. The system also provides means for adjusting the amount of light which is allowed to pass along the test path. But in the device of the '178 patent the light path passes through a very small aperture. Thus, very little light is allowed to reach the photodiode and very minute variations in the amount of that light will have a significant effect. Accordingly, the parts must be made to very exacting tolerances. Furthermore, since the test light path does not pass through the smoke chamber, the system does not test the condition of the smoke chamber. This is significant since spurious obscuring bodies, such as spider webs or the like, could be present in the smoke chamber which would falsely tend to indicate the presence of smoke. Such foreign matter cannot be detected with the test apparatus of the '178 patent.

Other prior art techniques involve inserting a test member into the smoke chamber for scattering the light from the light source. Such a system is disclosed in U.S. Pat. No. 3,868,184. But the relative signal from a smoke particle in the scattering region of the smoke chamber depends on its location, and a slight difference in relative signal strength. Thus, systems such as that disclosed in the '184 patent, wherein the test member is inserted in the normal scattering region of the smoke chamber, tend to be relatively inaccurate because it is extremely difficult to precisely place the light-scattering test object in the scattering region and to precisely determine the appropriate size for the test object.

SUMMARY OF THE INVENTION

The present invention provides a photoelectric smoke detector with improved test apparatus which avoids the disadvantages of prior art test devices while affording additional structural and operating advantages.

It is a general object of this invention to provide continuously adjustable test means for providing an indication of the amount of smoke required to activate the alarm of a smoke detector.

It is another object of this invention to provide test apparatus of the type set forth which provides an accurate indication of the sensitivity of the smoke detector.

It is another object of this invention to provide a test apparatus of the type set forth which is characterized by simplicity of operation and economical construction.

It is another object of this invention to provide a test apparatus of the type set forth which tests the conditions within the smoke chamber and tests the responsiveness of the detector to the light source used in normal operation.

Still another object of this invention is the provision of an improved test apparatus of the type set forth which can be constructed to relatively broad tolerances.

These and other objects of the invention are attained by providing test means for a smoke detector device having a light source, light responsive means, and a smoke chamber therebetween, light from the light source being directed through a predetermined scattering region of the smoke chamber and reflected from smoke in the scattering region to the light responsive means for activating an alarm at a predetermined smoke density in the scattering region, the test means comprising: control means shiftable between a normal condition and a test condition, the control means including light reflecting means disposed outside the scattering region, the control means in the normal condition thereof maintaining the light reflecting means in non-reflective relationship with respect to the light entering the smoke chamber from the light source, the control means in the test condition thereof causing light entering the smoke chamber from the light source to intercept the light reflecting means outside the scattering region and be reflected by the light reflecting means to the light responsive means for causing the light responsive means to respond as if the predetermined smoke density were in the scattering region for actuating the alarm.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

FIG. 8 is a fragmentary and partially diagrammatic sectional view of the smoke detector taken generally along the line 8—8 in FIG. 3 and illustrating the light paths from the light source to the photodiode when the device is in its test condition;

FIG. 8A is a diagrammatic view similar to FIG. 8 showing the scattering volume of the smoke chamber.

FIG. 9 is a partially diagrammatic view in horizontal section taken generally along the line 9—9 in FIG. 8 and rotated 90 degrees and illustrating the smoke detector in its maximum test condition;

FIG. 10 is a view similar to FIG. 9 and illustrating the smoke detector in its minimum test condition;

FIG. 11 is a fragmentary view similar to FIGS. 9 and 10 and illustrating the smoke detector in its normal condition;

FIG. 12 is a fragmentary top plan view similar to the inner portion of FIG. 5, illustrating an alternative embodiment of the present invention;

FIG. 13 is a fragmentary view in vertical section taken along the line 13—13 in FIG. 12;

FIG. 14 is a fragmentary view similar to FIG. 12, illustrating still another alternative embodiment of the present invention; and FIG. 15 is an enlarged fragmentary view in vertical section taken along the line 15—15 in FIG. 14.

DESCRIPTION OF THE PREFERRED EMBODIMENTS

Figure 1:
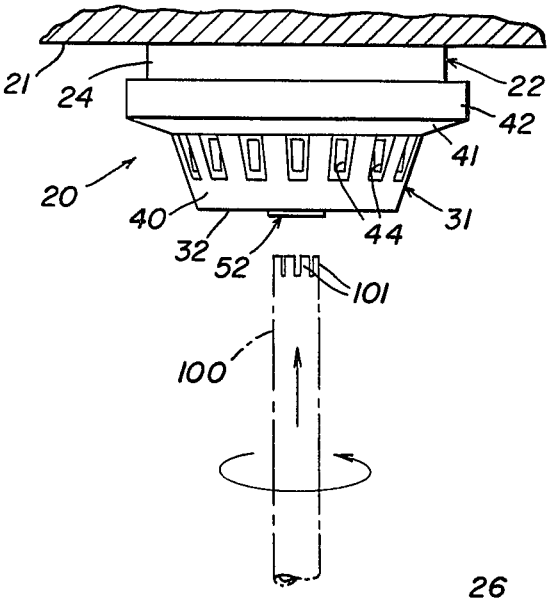
FIG. 1 is a side elevational view of a smoke detector constructed in accordance with and embodying the features of the present invention, shown mounted in place on a ceiling and illustrating the cooperation therewith of the test actuating tool.
Figure 2:
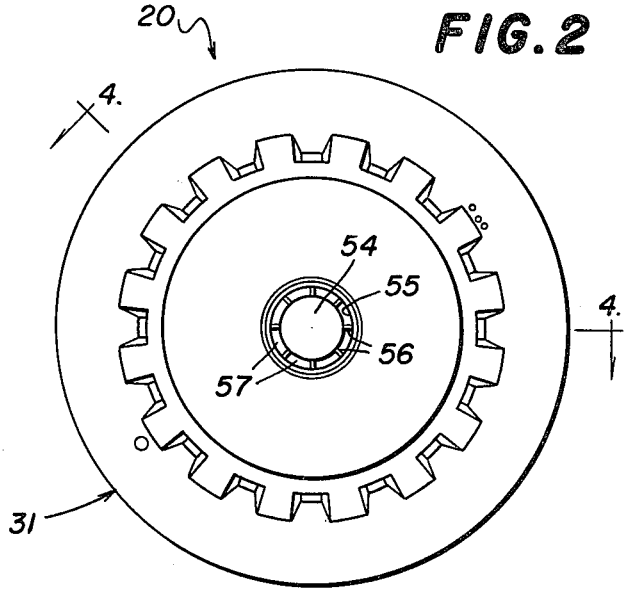
FIG. 2 is an enlarged bottom plan view of the smoke detector of FIG. 1.

Referring to FIGS. 1 through 5 of the drawings, there is illustrated a smoke detector, generally designated by the numeral 20, which includes sensitivity test apparatus constructed in accordance with and embodying the features of the present invention. The smoke detector 20 is normally adapted for attachment to a ceiling 21 by means of a mounting bracket, generally designated by the numeral 22, which includes a flat circular plate 23 provided around the peripheral edge thereof with a depending cylindrical side wall 24. The plate 23 is adapted to lie flush against the ceiling 21 and be fixedly secured thereto as by mounting screws 25. Integral with the side wall 24 adjacent to the lower end thereof and projecting radially inwardly, therefrom at spaced-apart locations therealong are four support flanges 26, each provided adjacent to one end thereof with an upstanding stop flange 27 (see FIG. 3).

Figure 6:
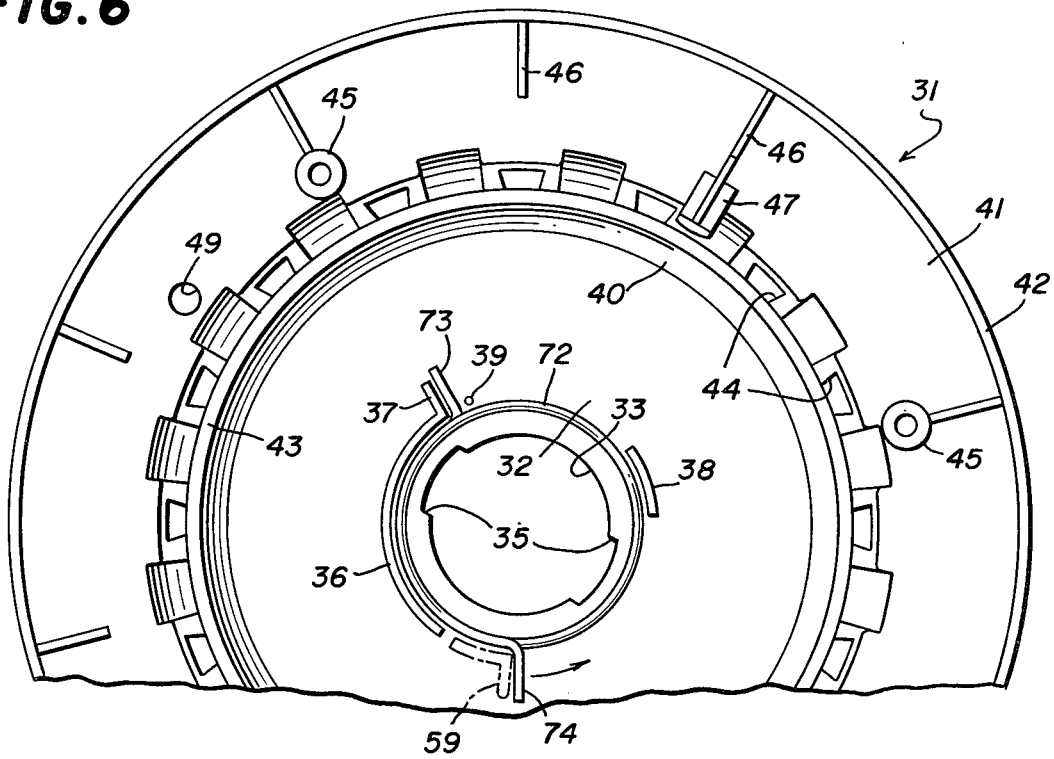
FIG. 6 is a fragmentary view similar to FIG. 5, illustrating the smoke detector with the inner housing removed.

Supported on the mounting bracket 22 is a housing assembly, generally designated by the numeral 30, which includes a cover or outer housing member 31 and a shield or inner housing member 50. Referring also to FIG. 6, the cover 31 includes a flat circular bottom wall 32 having a circular opening 33 therein centrally thereof. The outer surface of the bottom wall 32 is relieved around the perimeter of the opening 33 to form an annular shoulder 34 (see FIG. 4) having arcuate notches 35 formed therein at diametrically spaced-apart locations therealong. Formed on the inner surface of the bottom wall 32 are two upstanding arcuate retainer flanges 36 and 38 which lie along arcs of a common circle having a diameter greater than that of the opening 33 and concentric therewith. The retainer flange 36 is provided at one end thereof with a generally radially outwardly extending tab 37. Also extending upwardly from the bottom wall 32 a slight distance from the tab 37 is an upstanding pin 39.

The bottom wall 32 is integral at the outer edge thereof with an upwardly and outwardly sloping frustoconical side wall 40. The side wall 40 is in turn integral at its upper end with an outwardly and upwardly sloping annular flange 41 continuous at its outer edge with an upstanding cylindrical flange 42. Formed on the inner surface of the side wall 40 approximately midway between the upper and lower ends thereof is an annular shoulder 43 (see FIG. 4). The side wall 40 is also provided with a plurality of equidistantly spaced-apart slots 44 therearound, each of the slots 44 extending vertically from the annular shoulder 43 to the sloping flange 41. Integral with the inner surface of the sloping flange 41 and extending upwardly therefrom at spaced-apart points therealong are three mounting posts 45 each generally cylindrical in shape. The cover 31 is also provided at spaced-apart points along the inner surface thereof with a plurality of stiffening ribs 46 interconnecting the sloping flange 41 and the cylindrical flange 42. Also provided on the inner surface of the sloping flange 41 at diametrically spaced-apart locations thereon are two retaining flanges 47, each projecting radially inwardly beyond the inner edge of the sloping flange 41 a predetermined distance above the upper end of the side wall 40. The sloping flange 41 also carries an upstanding stop flange 48 on the inner surface thereof and has a circular aperture 49 therethrough for a purpose to be described below.

Figure 7:
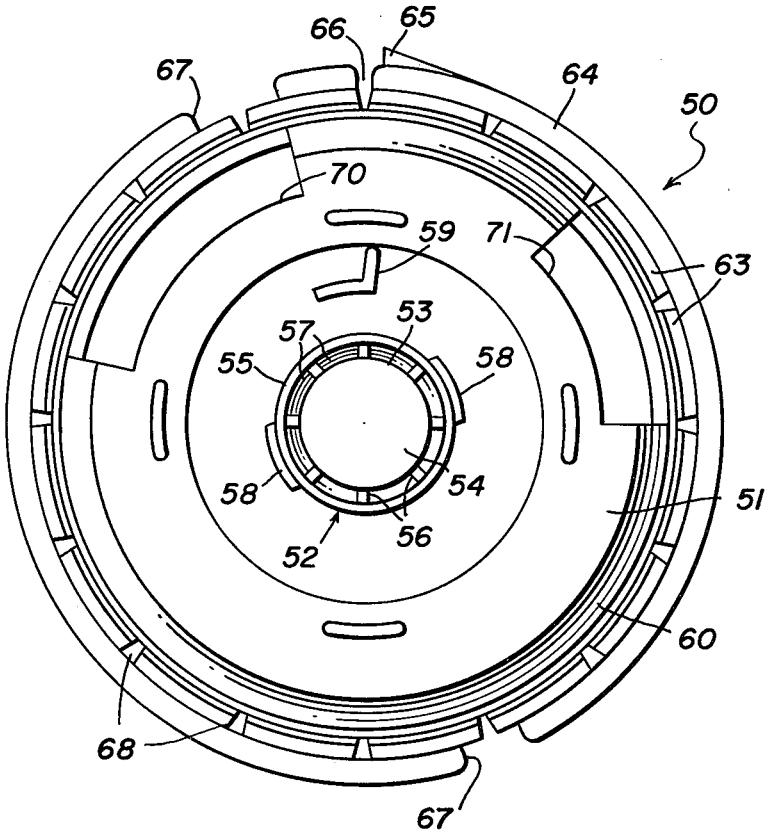
FIG. 7 is bottom plan view of the inner housing which was removed from FIG. 6.

Referring now also to FIG. 7 of the drawings, the shield 50 is dimensioned to fit within the frustoconical side wall 40 of the cover 31, and includes a circular end wall 51 having an outwardly projecting cylindrical hub portion 52 centrally thereof. The hub portion 52 includes a depending inner cylindrical wall 53 closed at the lower end thereof by a circular end wall 54 and an outer cylindrical wall 55 concentric with the inner wall 53 and spaced a predetermined distance outwardly thereof. Interconnecting the inner and outer walls 53 and 55 at equiangularly spaced apart points therealong is a plurality of radial webs 56 cooperating to define therebetween a plurality of arcuate slots 57. Integral with the outer cylindrical wall 55 and extending laterally outwardly therefrom at diametrically spaced apart locations therealong are two arcuate tabs 58. Formed on the outer surface of the end wall 51 and extending outwardly therefrom is a retainer flange 59, for a purpose to be explained below.

Integral with the end wall 51 around the peripheral edge thereof and extending upwardly and outwardly therefrom is a frustoconical side wall 60 (see FIG. 4) provided adjacent to the upper end thereof with a short cylindrical positioning flange 61 depending from the outer surface of the side wall 60 coaxially therewith (see also FIG. 15). Also integral with the side wall 60 at the upper edge of the positioning flange 61 is a radially outwardly extending short annular support flange 62. Integral with the side wall 60 and extending upwardly and outwardly therefrom at equidistantly spaced-apart points therealong is a plurality of generally rectangular outer vanes 63 interconnected adjacent to the upper ends thereof by a radially outwardly extending annular connecting ring 64. The connecting ring 64 has a radially outwardly flared portion 65 immediately adjacent to a short break 66 therein. Also formed in the connecting ring 64 are two rectangular gaps 67. The outer vanes 63 cooperate to define therebetween a plurality of rectangular slots 68.

Integral with the side wall 60 and extending vertically upwardly therefrom at equidistantly spaced-apart points therealong is a plurality of generally rectangular inner vanes 69 each spaced a predetermined distance radially inwardly of the outer vanes 63 and dimensioned and positioned respectively to cover the slots 68 between the outer vanes 63. Formed in the shield 50 are two windows or apertures, including a relatively long window 70 and a relatively short window 71, each formed at the junction between the side wall 60 and the end wall 51 and extending a predetermined distance radially inwardly along the end wall 51 and a predetermined distance upwardly along the side wall 60.

In use, the shield 50 nests within the cover 31, with the annular support flange 62 resting upon the annular shoulder 43 for suspending the shield end wall 51 a predetermined slight distance above the cover bottom wall 32, the hub portion 52 of the shield 50 being disposed through the central opening 33 of the cover 31, the two tabs 58 being respectively accommodated by the notches 35. When the shield 50 is thus assembled with the cover 31, the tabs 58 on the hub portion 52 extend just below the shoulder 34 surrounding the central aperture 33 in the cover bottom wall 32. The connecting ring 64 will be disposed immediately above the inner edge of the sloping annular flange 41 of the cover 31 (see FIGS. 4 and 5). In this regard, the gaps 67 in the connecting ring 64 are dimensioned and positioned for respectively accommodating passage therethrough of the retaining flanges 47 on the cover 31, so that when the shield 50 is positioned within the cover 31, the upper surface of the connecting ring 64 lies just below the retaining flanges 47.

A torsion spring 72 is disposed between the shield end wall 51 and the cover bottom wall 32 in surrounding relationship with the hub portion 52. More particularly, referring to FIGS. 4, 6 and 7, the torsion spring 72 is disposed in surrounding relationship with the central aperture 33 and just inside the arcuate retaining flanges 36 and 38 on the cover bottom wall 32, the torsion spring 72 havng a radially outwardly extending retaining arm 73 at one end thereof disposed between the tab 37 and the pin 39, and a radially outwardly extending retaining arm 74 at the other end thereof disposed for engagement with the depending retaining flange 59 of the shield 50.

Figure 4:
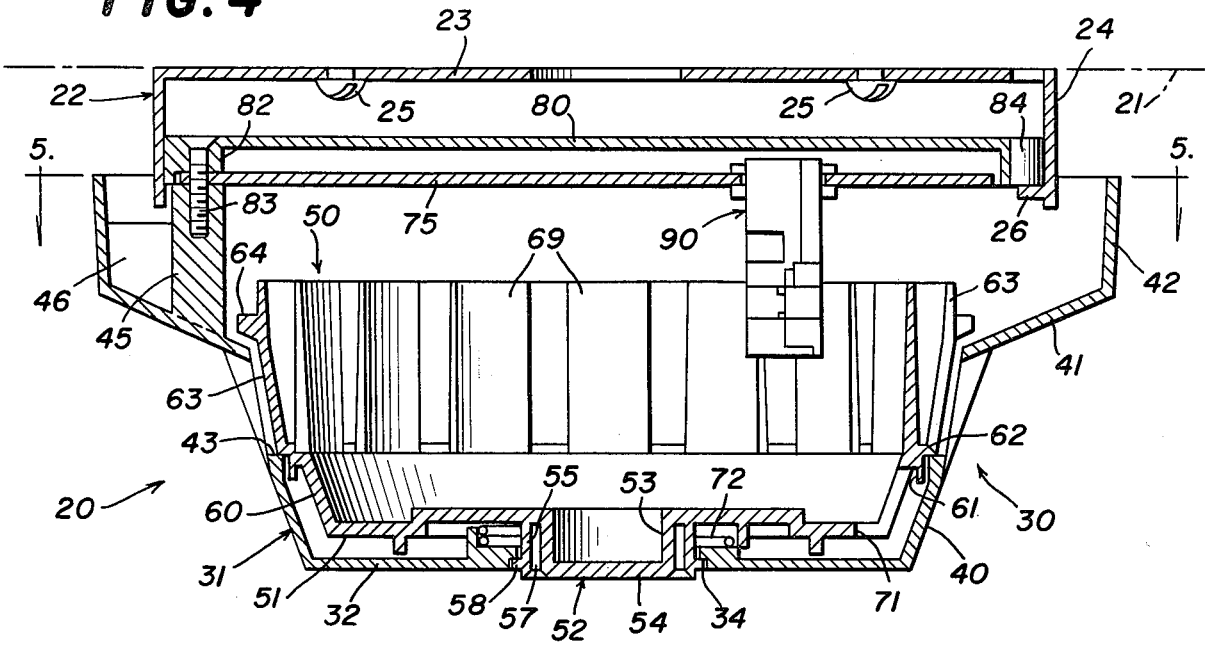
FIG. 4 is an enlarged view in vertical section taken along the line 4—4 in FIG. 2.
Figure 5:
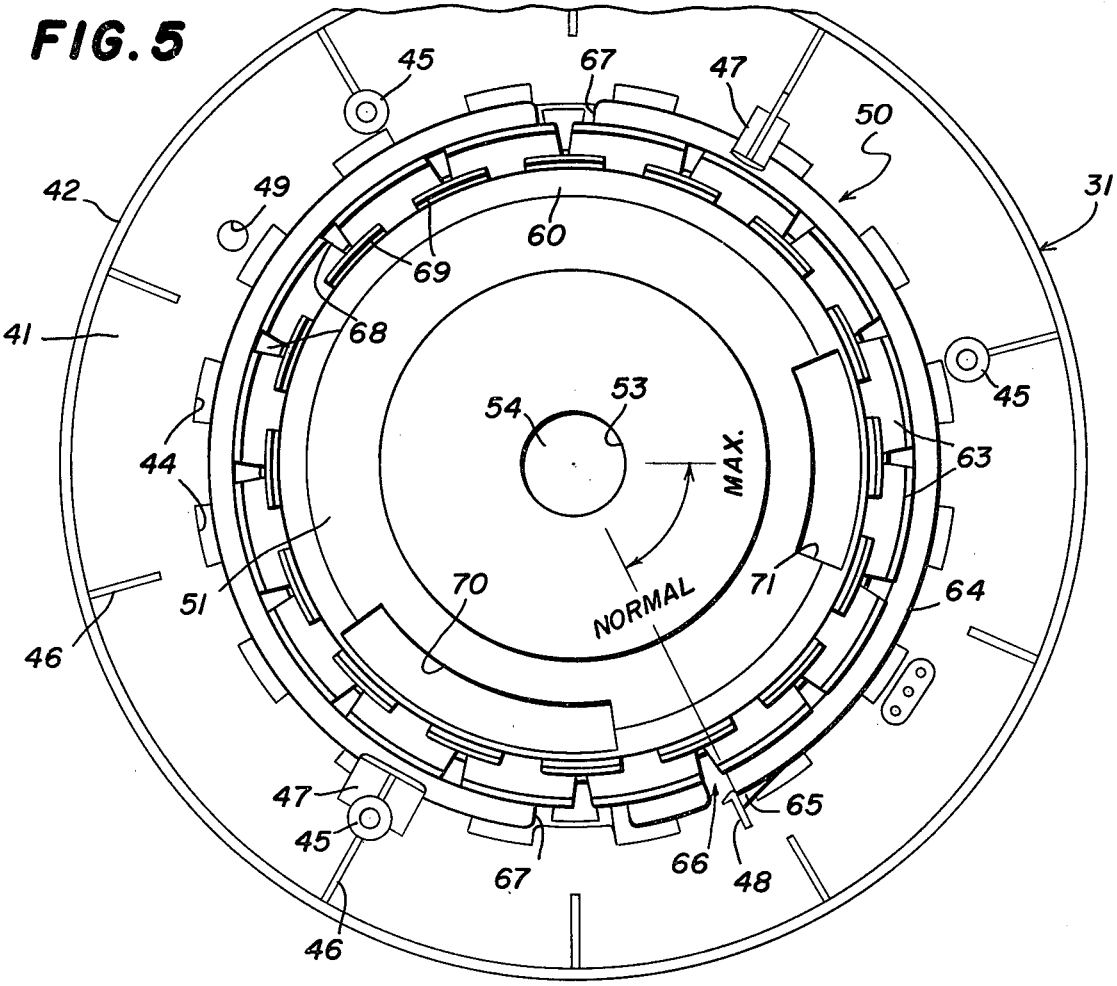
FIG. 5 is a fragmentary view in horizontal section taken along the line 5—5 in FIG. 4.

In assembling the parts, the shield 50 is rotated in a counterclockwise direction, as viewed in FIG. 5, until the flared portion 65 of the connecting ring 64 is cammed past the stop flange 48 and snaps back into retaining position therebehind, as best illustrated in FIG. 5, this flexure of the connecting ring 64 being facilitated by the break 66 therein. This rotation brings the retaining flange 59 of the shield 50 into the position illustrated in FIG. 6, against the retaining arm 74 of the torsion spring 72. In this normal assembled configuration illustrated in FIGS. 3 and 4, the slots 68 of the shield 50 are respectively aligned with the slots 44 of the cover 31.

The housing assembly 30 is thus completed and ready for use, the shield 50 being rotatably movable with respect to the cover 31 between normal and maximum rotation positions illustrated by the double-ended arrow in FIG. 5. Rotation of the shield 50 from the normal position to the maximum position thereof is in counterclockwise direction, as viewed in FIG. 5, against the urging of the torsion spring 72, this rotation being limited by engagement of the retaining arm 74 of the torsion spring 72 with the retainer flange 38. The shield 50 then returns to the normal position under the urging of the torsion spring 72, being stopped in this position by engagement of the flared portion 65 of the connecting ring 64 with the stop flange 48. Accidental removal of the shield 50 from the cover 30 is prevented by engagement of the tabs 58 with the shoulder 34 and by engagement of the retaining flanges 47 with the connecting ring 64.

A generally circular flat circuit board 75 is mounted on the housing assembly 30, the circuit board 75 having four flat edges 78 along chords thereof at equiangularly spaced-apart locations therealong, one of the flat edges 78 having a short rectangular spacer notch 79 formed therein for a purpose to be explained below. The circuit board 75 has a diameter less than the inner diameter of the cylindrical side wall 24 of the mounting bracket 22, and rests upon the mounting posts 45. The circuit board 75 is preferably of the printed circuit variety, having printed conductors along one side thereof and discrete electronic components (not shown) mounted on the other side thereof.

Overlying the circuit board 75 is a circular adapter plate 80 having a peripheral flange 81 depending therefrom along the perimeter thereof. Also depending from the adapter plate 80 just inside the flange 81 are three circular bushings 82 respectively positioned for registry with the mounting posts 45 and for respectively receiving therethrough fasteners, such as screws 83, for fixedly securing together the adapter plate 80, the circuit board 75 and the cover 31. The adapter plate 80 and the flange 81 have four indented or recessed portions 84 at equiangularly spaced-apart locations thereon, the flange 81 having a positioning flange 86 projecting radially inwardly therefrom centrally of one of these recessed portions 84. The positioning flange 86 is received in the notch 79 in the circuit board 75 for accurate positioning of the parts with respect to each other. It will be appreciated that when the parts are thus assembled, the circuit board 75 cooperates with the shield 50 for defining therebetween a smoke chamber, generally designated by the numeral 85 (see FIG. 8). Smoke is permitted to enter and leave the smoke chamber 85 through the aligned slots 44 and 68 in the cover 31 and shield 50, ambient light being prevented from entering the smoke chamber 85 by the inner vanes 69 of the shield 50.

Figure 3:
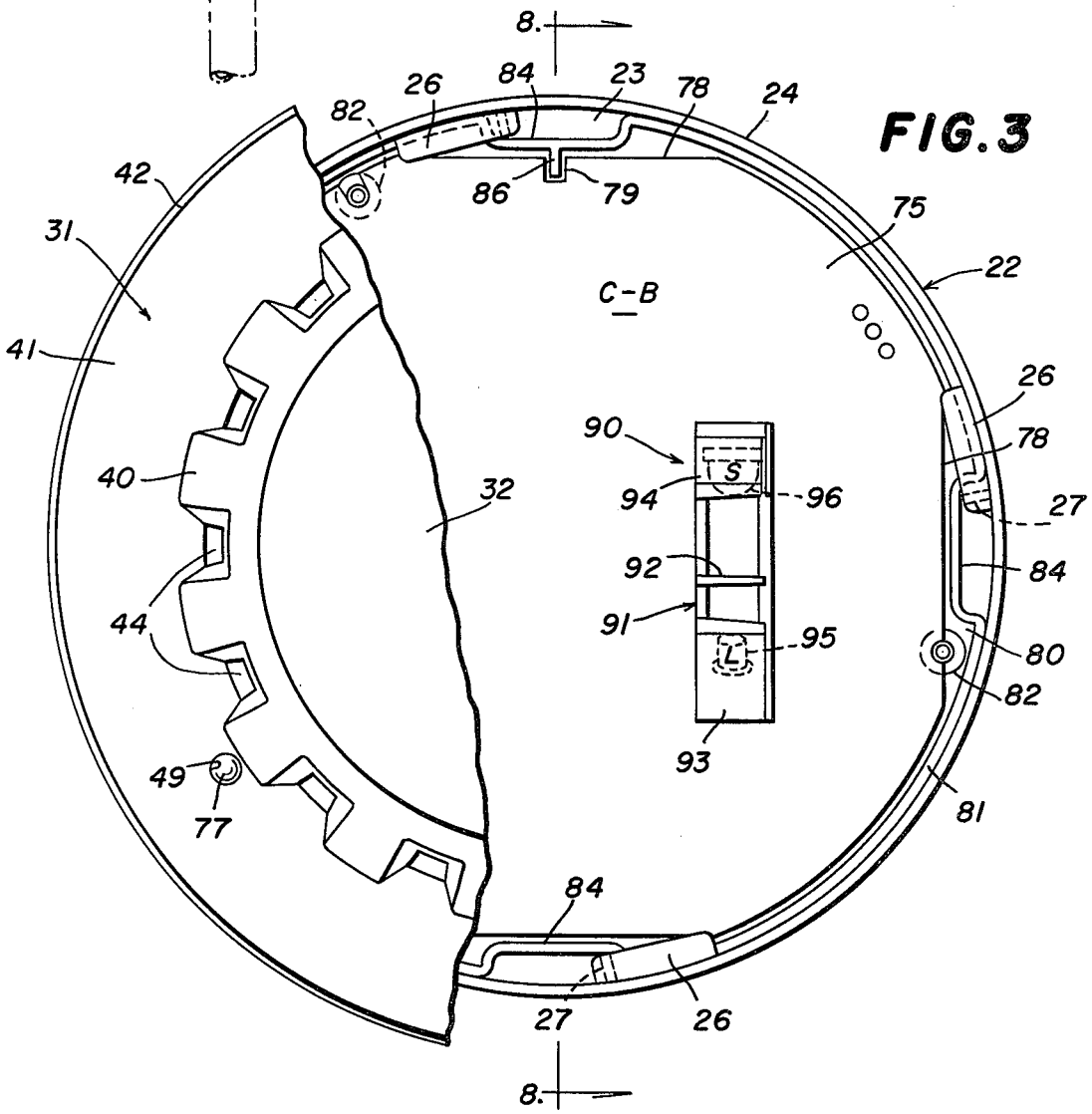
FIG. 3 is a further enlarged view similar to FIG. 2, with a portion of the housing broken away better to illustrate the internal construction of the smoke detector.

When it is desired to mount the housing assembly 30 by means of the mounting bracket 22, it will be appreciated that the support flanges 26 of the mounting bracket 22 are respectively accommodated in the recessed portions 84 of the adapter plate 80, the housing assembly 30 being moved upwardly until the lower edge of the peripheral flange 81 is positioned above the support flanges 26 (see FIGS. 3 and 4). The housing assembly 30 may then be rotated in either direction to move the recessed portions 84 out of registry with the support flanges 26, whereupon the peripheral flange 81 will be supported upon the support flanges 26.

Mounted on the circuit board 75 and depending therefrom into the smoke chamber 85 is an optical assembly, generally designated by the numeral 90. The optical assembly 90 includes a generally hollow open-bottom housing 91, the interior of which is divided by a septum 92 which is reflective at least at its lower end. Partially closing the open bottom of the housing 91 on opposite sides of the septum 92 are shield flanges 93 and 94 which respectively terminate at inner edges spaced a predetermined distance from the septum 92. Mounted within the housing 91 immediately above the shield flange 93 is a light source such as an LED 95, and mounted within the housing 91 immediately above the shield flange 94 is a light-responsive device such as a photodiode 96.

There is also provided an elongated cylindrical actuating tool 100 provided at the upper end thereof with a plurality of notches for forming teeth 101, respectively dimensioned for being fitted into the slots 57 in the shield hub portion 52. Thus, the actuating tool 100 forms a key which can be rotated for effecting rotation of the shield 50 with respect to the cover 31. If desired, the actuating tool 100 may be provided with a long handle so that the shield 50 may be rotated by a user from the floor.

Referring now in particular to FIGS. 8 through 11 of the drawings, the operation of the smoke detector 20 will now be explained in detail. The shield 50 is formed of a black non-reflective material, while at least the inner surfaces of the bottom wall 32 and side wall 40 of the cover 31 are light-reflective. When the housing assembly 30 is mounted in place on the mounting bracket 22, the flange 42 of the cover 31 overlaps the side wall 24 of the mounting bracket 22 closely adjacent to the associated ceiling 21 so as effectively to prevent ambient light from entering the smoke chamber 85. Light is prevented from entering the smoke chamber 85 through the slots 44 and 68 by the inner vanes 69 of the shield 50, as explained above. Accordingly, virtually the only light present within the smoke chamber 85 is that provided by the LED 95.

In normal operation, the light from the LED 95 is directed along many paths into the smoke chamber 85, some of the paths proceeding directly into the smoke chamber 85 and some by reflection from the septum 92. The direct light paths from the LED 95 into the smoke chamber 85 form a cone generally bounded by the lines W and X in FIG. 8A. Similarly, light can pass from the smoke chamber 85 to the photodiode 96 along a number of paths, some direct and some reflected from the septum 92. The direct light paths from the smoke chamber 85 to the photodiode 96 form a cone generally bounded by the lines Y and Z in FIG. 8A. The region of overlap of the cones WX and YZ defines the scattering volume SV and is designated by hatched lines in FIG. 8A. When smoke particles are present in the scattering volume SV, they reflect light from the LED 95. Some of this light will be reflected directly to the photodiode 96. When the smoke density in the scattering volume SV is above a predetermined minimum level, the amount of light reflected from the smoke particles and impinging on the photodiode 96 will be sufficient to cause the photodiode 96 to actuate an alarm signal through associated circuitry on the circuit board 75, all in a well-known manner.

When smoke is not present in the smoke chamber 85, light from the LED 95 entering the smoke chamber 85 will eventually reach the shield 50, but will not be reflected therefrom because of the black non-reflective nature thereof. Because of the positioning of the septum 92, light from the LED 95 cannot reach the photodiode 96 along a direct path. Accordingly, in the absence of smoke in the smoke chamber 85, virtually no light reaches the photodiode 96. In normal operation, the windows 70 and 71 are so positioned with respect to the optical assembly 90, that virtually none of the light from the LED 95 passes therethrough.

When it is desired to test the sensitivity of the smoke detector 20, the shield 50 is rotated in a counterclockwise direction, as viewed in FIG. 5 to a position wherein at least certain ones of the light paths from the LED 95, two of which are designated 110 and 120 in FIG. 8, begin to pass respectively through the windos 70 and 71 at the leading edges thereof, as illustrated in FIG. 10. Because the inner surface of the side wall 40 of the cover 31 is reflective, any light which passes through the windows 70 and 71 will tend to be reflected back therethrough into the smoke chamber 85. More particularly, some of the light which is emitted from the LED 95 along the path 110 will be reflected back to the photodiode 96 via the septum 92, and some of the light which passes through the window 71 along the path 120 will be reflected back to the photodiode 96. As rotation of the housing 50 is continued, more and more light will pass through the windows 70 and 71 and, therefore, more light will be reflected back to the photodiode 96. At some point, the amount of light reflected back to the photodiode 96 will be sufficient to actuate the alarm, theereby simulating the presence in the smoke chamber 85 of the predetermined density of smoke necessary for actuating the alarm.

Accordingly, it can be seen that the amount of light reaching the photodiode 96 is proportional to the degree of rotation of the shield 50 which is, in turn, a measure of the sensitivity of the smoke detector 20. In other words, a slight rotation of the shield 50 permits only a small amount of light to reach the photodiode 96, simulating a very low density of smoke in the smoke chamber 85, while a maximum rotation of the shield 50 permits maximum light to reach the photodiode 96 and simulates the presence of a high density of smoke in the smoke chamber 85.

Thus, it can be seen that the further the shield 50 has to be rotated in order to actuate the alarm during this test procedure, the less sensitive is the smoke detector 20. It will be appreciated that graduated indicia may be provided on the housing assembly 30 to provide a direct reading of the sensitivity of the smoke detector 20. If the sensitivity of the device is low, or if the alarm fails to actuate when the shield 50 is rotated to its maximum test position, this is an indication that there may be a defect in the LED or in the photodiode or both, or that there may be an obstruction in the smoke chamber 85. Preferably, the device is calibrated so that, at optimum sensitivity, the alarm will be activated upon a relatively slight rotation of the windows 70 and 71 into the light paths 110 and 120.

It is a significant feature of the present invention that the rotating test apparatus provides a continuous gauge of sensitivity, thereby facilitating precise and accurate measurement of the sensitivity of the device. With this system it is possible to measure sensitivity down to 2% obscuration per foot with an accuracy of ±0.5% obscuration per foot. Yet, because the test reflector is outside the scattering volume, the device can be constructed with relatively broad tolerances. Furthermore, because the test procedure utilizes the same light source as is used in normal smoke detecting operation, and because the test light path passes through the smoke chamber 85, it is possible to detect obscuration of the smoke chamber 85 by foreign material such as spider webs and the like. Thus, if the alarm is not actuated in the full test position of the shield 50, the user would first check the smoke chamber 85 to be sure that the light path is not being obstructed by some foreign body.

While in the preferred embodiment, the smoke detector 20 has been disclosed with a fixed cover 31 and a shield 50 rotatable with respect to the cover 31, it will be appreciated that the smoke detector 20 could also be arranged with a fixed shield 50 and a movable cover 31. Furthermore, referring to FIGS. 12 and 13 of the drawings, it would also be possible to provide the shield 50 with one or more reflective inner vanes 169 in addition to or in lieu of the windows 70 and 71. In this embodiment, the shield 50 is rotated until the reflective vanes 169 were moved into the light paths 110 and 120. Another alternative, depicted in FIGS. 14 and 15, is to provide in lieu of the windows 70 and 71 reflective portions 170 and 171 in the corresponding regions of the shield 50. These reflective portions could be provided by coating the inner surface of the shield 50 in these regions with a reflective paint or with a reflective tape. Alternatively, reflective inserts could be provided for insertion into the apertures of the windows 70 and 71. This embodiment would operate in exactly the same manner as that disclosed in FIGS. 1 through 7, except that the light would not leave the smoke chamber 85.

In a constructional model of the present invention, the mounting bracket 22, the cover 31, the shield 50 and the adapter plate 80 may all be formed of plastic, each of these pieces preferably being of one-piece molded construction. It will also be understood that the smoke detector 20 may be adapted for being operated by battery power or by AC power.

From the foregoing, it can be seen that there has been provided an improved smoke detector and particularly a test apparatus therefor which provides a simple and inexpensive, yet accurate measurement of the sensitivity of the smoke detector.

What is claimed is:

1. Test means for a smoke detector device having a light source, light responsive means, and a smoke chamber therebetween, light from the light source being directed through a predetermined scattering region of the smoke chamber and reflected from smoke in the scattering region to the light responsive means for activating an alarm at a predetermined smoke density in the scattering region, said test means comprising: control means shiftable between a normal condition and a test condition, said control means including light reflecting means disposed outside the scattering region, said control means in the normal condition thereof maintaining said light reflecting means in non-reflective relationship with respect to the light entering the smoke chamber from the light source, said control means in the test condition thereof causing light entering the smoke chamber from the light source to intercept said light reflecting means outside the scattering region and be reflected by said light reflecting means to the light responsive means for causing the light responsive means to respond as if the predetermined smoke density were in the scattering region for actuating the alarm.

2. The test means of claim 1, and further including housing means defining the smoke chamber, said light reflecting means being permanently disposed adjacent to said housing means.

3. The test means of claim 1, and further including housing means defining the smoke chamber, said light reflecting means being disposed on said housing means.

4. The test means of claim 1, wherein said control means is continuously movable between the normal condition and a full test condition through a range of intermediate test conditions.

5. The test means of claim 1, wherein said light reflecting means is movable into and out of a path along which light from the light source is directed to the smoke chamber.

6. The test means of claim 1, wherein said control means includes two spaced-apart light reflecting means respectively adapted for movement into and out of plural paths along which light from the light source is directed to the smoke chamber.

7. The test means of claim 1, and further including bias means resiliently biasing said control means to the normal condition thereof.

8. The test means of claim 1, wherein said control means includes housing means defining the smoke chamber and having an aperture therein, said light reflecting means being disposed outside said housing means, said control means effecting relative movement of said housing means and said light reflecting means so that in the test condition thereof said aperture is positioned to permit light to pass therethrough to the light reflecting means.

9. A smoke detector comprising housing means defining a smoke chamber, an optical assembly including a light source and light responsive means, said optical assembly being arranged so that light from said light source is directed to said smoke chamber and reflected from smoke in said chamber to said light responsive means for activating an associated alarm at a predetermined smoke density, one of said optical assembly and said housing means being movable with respect to the other between a normal condition and a test condition, said optical assembly and said housing means cooperating in the normal condition for preventing light from said light source which enters said smoke chamber from reaching said light responsive means when less than the predetermined smoke density is present in said chamber, said optical assembly and said housing means cooperating in the test condition for causing light entering said smoke chamber from said light source to reach said light responsive means in an amount sufficient for causing said light responsive means to respond as if the predetermined smoke density were in said smoke chamber for actuating the alarm.

10. The smoke detector of claim 9, wherein said housing means is movable with respect to said optical assembly between the normal and test conditions.

11. The smoke detector of claim 9, wherein said housing means includes two parts, one of said parts being fixed with respect to said optical assembly, the other of said parts being movable with respect to said optical assembly between the normal and test conditions.

12. In a smoke detector device having a light source, light responsive means and a smoke chamber therebetween, light from the light source being directed to the smoke chamber and reflected from smoke in the chamber to the light responsive means for activating an alarm at a predetermined smoke density, the improvement comprising: housing means defining the smoke chamber, said housing means being rotatably movable with respect to the light source between a normal condition and a test condition, said housing means in the normal condition thereof preventing light from the light source which enters the smoke chamber from reaching the light responsive means when less than the predetermined smoke density is present in the chamber, said housing means in the test condition thereof causing light entering the smoke chamber from the light source to reach the light responsive means in an amount sufficient for causing the light responsive means to respond as if said predetermined smoke density were in the smoke chamber for actuating the alarm.

13. The improvement of claim 12, and further including light reflecting means carried by said housing means and movable therewith into and out of the path along which light from the light source is directed to the smoke chamber.

14. The improvement of claim 13, wherein said light reflecting means comprises a light-reflecting portion of said housing means.

15. The improvement of claim 12, and further including light reflecting means disposed outside said housing means, said housing means having an aperture therein accommodating passage of light therethrough to said light reflecting means when said housing means is in the test condition thereof for reflecting light to the light responsive means.

16. The improvement of claim 12, wherein said housing means includes means for causing light entering the smoke chamber from the light source along different paths to reach the light responsive means.

17. The improvement of claim 12, and further including actuating means adapted for cooperation with said housing means for effecting movement thereof between the normal and test conditions thereof.

18. In a smoke detector device having a light source, light responsive means and a smoke chamber therebetween, light from the light source being directed to the smoke chamber and reflected from smoke in the chamber to the light responsive means for actuating an alarm at a predetermined smoke density, the improvement comprising: housing means including an outer cylindrical housing member and an inner cylindrical housing member disposed within said outer housing member coaxially therewith and defining the smoke chamber, one of said housing members being rotatable with respect to the other of said housing members about the axis thereof between a normal condition of said housing means and a test condition of said housing means, said housing means in the normal condition thereof preventing light from the light source which enters the smoke chamber from reaching the light responsive means when less than the predetermined smoke density is present in the chamber, said housing means in the test condition thereof causing light entering the smoke chamber from the light source to reach the light responsive means in an amount sufficient for causing the light responsive means to respond as if the predetermined smoke density were in the smoke chamber for actuating the alarm.

19. The improvement of claim 18, wherein said inner housing member is movable with respect to said outer housing member.

20. The improvement of claim 19, wherein said outer housing member is fixed in position.

21. The improvement of claim 18, and further including light reflecting means on said outer housing member, said inner housing member having an aperture therethrough, said aperture being positioned to permit light to pass therethrough to said light reflecting means when said housing means is in the test condition thereof.

22. The improvement of claim 21, wherein said outer housing member has two light reflecting means thereon, said inner housing member having two apertures therethrough, said apertures being respectively positioned for permitting light to pass therethrough to said two light reflecting means when said housing means is in the test condition thereof for reflecting light to the light responsive means along two separate paths.

23. The improvement of claim 18, wherein said inner housing member has light reflecting means thereon for reflecting light to the light responsive means when said housing means is in the test condition thereof.

24. The improvement of claim 23, wherein said inner housing member has two spaced-apart light responsive means thereon, said light responsive means being respectively positioned for reflecting light to light responsive means along two separate paths when said housing means is in the test condition thereof.

25. The improvement of claim 18, and further including a torsion spring coupled between said inner and outer housing members for resiliently biasing said housing means to the normal condition thereof.

26. In a smoke detector device having a light source, light responsive means and a smoke chamber therebetween, light from the light source being directed to the smoke chamber and reflected from smoke in the chamber to the light responsive means for actuating an alarm at a predetermined smoke density, the improvement comprising: a first housing member having a first cylindrical side wall closed at one end thereof by a first end wall, a second housing member disposed within said first housing member and having a second cylindrical side wall disposed coaxially with said first side wall and closed at one end thereof by a second end wall disposed adjacent to said first end wall, said second housing member being adapted for rotational movement with respect to said first housing member about the axis thereof between a normal condition and a test condition, said second housing member in the normal condition thereof preventing light from the light source which enters the smoke chamber from reaching the light responsive means when less than the predetermined smoke density is present in the chamber, said second housing member in the test condition thereof causing light entering the smoke chamber from the light source to reach the light responsive means in an amount sufficient for causing the light responsive means to respond as if the predetermined smoke density were in the smoke chamber for actuating the alarm, said second end wall having a coupling portion thereon, said first end wall having an opening therein for providing access to said coupling portion, and an actuating member adapted for insertion through said opening and engagement with said coupling portion for effecting movement of said second housing member between the normal and test conditions thereof.

27. The improvement of claim 26, wherein said opening is located centrally of said first end wall.

28. The improvement of claim 26, wherein said second end wall has a key recess formed therein, said actuating member being insertable through said opening and into said key recess for engagement with said second end wall.

29. The improvement of claim 28, wherein said key recess is circular in shape, said actuating member being cylindrical in shape for mating engagement in said cylindrical recess.

30. The improvement of claim 26, wherein said opening is disposed centrally of said first end wall, said second end wall having a cylindrical hub portion extending axially therefrom centrally thereof and projecting into said opening, said coupling portion being formed on said hub portion.

31. The improvement of claim 26, and further including light reflecting means on said first housing member, said second housing member having an aperture therethrough, said aperture being positioned to permit light to pass therethrough to said light reflecting means when said second housing member is in the test condition thereof.

32. The improvement of claim 26, wherein said second housing member has light reflecting means thereon for reflecting light to the light responsive means when said second housing member is in the test condition thereof.

* * * * *